US009083114B2

(12) United States Patent
Muro

(10) Patent No.: US 9,083,114 B2
(45) Date of Patent: Jul. 14, 2015

(54) CONNECTOR

(75) Inventor: Takashi Muro, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 61 days.

(21) Appl. No.: 14/006,374

(22) PCT Filed: Jun. 22, 2012

(86) PCT No.: PCT/JP2012/066053

§ 371 (c)(1),
(2), (4) Date: Sep. 20, 2013

(87) PCT Pub. No.: WO2012/176898

PCT Pub. Date: Dec. 27, 2012

(65) Prior Publication Data

US 2014/0011388 A1 Jan. 9, 2014

(30) Foreign Application Priority Data

Jun. 24, 2011 (JP) ..... 2011-140766

(51) Int. Cl.
*H01R 13/627* (2006.01)
*H01R 13/436* (2006.01)

(52) U.S. Cl.
CPC ..... *H01R 13/627* (2013.01); *H01R 13/4362* (2013.01)

(58) Field of Classification Search
CPC ..... H01R 13/4362; H01R 13/627
USPC ..... 439/752
See application file for complete search history.

(56) References Cited

U.S. PATENT DOCUMENTS

| | | | |
|---|---|---|---|
| 5,609,503 | A | 3/1997 | Tsuji et al. |
| 5,797,772 | A | 8/1998 | Sakurai et al. |
| 5,848,919 | A | 12/1998 | Nagano |
| 6,010,374 | A | 1/2000 | Miwa |

(Continued)

FOREIGN PATENT DOCUMENTS

| | | | |
|---|---|---|---|
| CN | 101436726 | A | 5/2009 |
| GB | 2432466 | B | 7/2010 |

(Continued)

OTHER PUBLICATIONS

Written Opinion of the International Searching Authority dated Sep. 25, 2012 for corresponding International Application No. PCT/JP2012/066053.

(Continued)

*Primary Examiner* — Ross Gushi
(74) *Attorney, Agent, or Firm* — Morgan, Lewis & Bockius LLP

(57) ABSTRACT

A connector includes a connector housing that receives a terminal fitting, a spacer that is inserted into a spacer installation opening of the connector housing to prevent the terminal fitting received in the connector housing from being fallen out, a temporary locking mechanism that temporarily fixes the spacer to a temporary locking position where the spacer is not engaged with the terminal fitting, a main locking mechanism that locks the spacer pushed toward a more inner side of the housing than the temporary locking position to a main locking position where the spacer is engaged with the terminal fitting. The temporary locking mechanism allows the spacer to move from the temporary locking position to the main locking position.

2 Claims, 17 Drawing Sheets

(56) References Cited

U.S. PATENT DOCUMENTS

| | | | | |
|---|---|---|---|---|
| 7,661,999 | B2 * | 2/2010 | Horiuchi et al. | 439/752 |
| 7,682,205 | B2 * | 3/2010 | Hall et al. | 439/752 |
| 7,762,854 | B1 * | 7/2010 | Peng | 439/752 |
| 7,828,606 | B2 * | 11/2010 | Singer | 439/752 |
| 7,828,607 | B2 * | 11/2010 | Kojima | 439/752 |
| 7,988,502 | B2 * | 8/2011 | Nagano et al. | 439/752 |
| 8,038,486 | B1 * | 10/2011 | Nakamura | 439/752 |
| 8,052,489 | B2 * | 11/2011 | Mase et al. | 439/752 |
| 8,096,841 | B2 * | 1/2012 | Hirano | 439/752 |
| 8,215,984 | B2 * | 7/2012 | Yokozeki | 439/540.1 |
| 8,282,427 | B2 * | 10/2012 | Yamazaki | 439/752 |
| 8,419,485 | B2 * | 4/2013 | Stausser et al. | 439/752 |
| 8,721,374 | B2 * | 5/2014 | Glick et al. | 439/752 |
| 8,721,375 | B2 * | 5/2014 | Hori | 439/752 |
| 8,727,816 | B2 * | 5/2014 | Takahashi et al. | 439/752 |
| 8,747,168 | B2 * | 6/2014 | Kida | 439/701 |
| 2001/0003689 | A1 * | 6/2001 | Kim | 439/752 |
| 2001/0049235 | A1 | 12/2001 | Furutani | |
| 2001/0051468 | A1 * | 12/2001 | Kashiyama et al. | 439/752 |
| 2002/0013105 | A1 * | 1/2002 | Kashiyama | 439/752 |
| 2002/0076995 | A1 * | 6/2002 | Kurimoto et al. | 439/752 |
| 2002/0127921 | A1 * | 9/2002 | Kashiyama | 439/752 |
| 2002/0137402 | A1 * | 9/2002 | Kashiyama et al. | 439/752 |
| 2002/0168895 | A1 * | 11/2002 | Suzuki | 439/595 |
| 2003/0068930 | A1 * | 4/2003 | Endo | 439/752 |
| 2003/0092324 | A1 * | 5/2003 | Walker et al. | 439/752 |
| 2003/0199206 | A1 * | 10/2003 | Mase et al. | 439/752 |
| 2004/0005821 | A1 * | 1/2004 | Nankou et al. | 439/752 |
| 2004/0152369 | A1 * | 8/2004 | Kashiyama | 439/752 |
| 2004/0253883 | A1 * | 12/2004 | Matsuoka | 439/752 |
| 2007/0128953 | A1 * | 6/2007 | Ciriello et al. | 439/752 |
| 2007/0212950 | A1 * | 9/2007 | Morello | 439/752 |
| 2007/0275609 | A1 * | 11/2007 | Lamdiziz et al. | 439/752 |
| 2009/0142958 | A1 | 6/2009 | Matsumura et al. | |
| 2010/0062660 | A1 * | 3/2010 | Itou et al. | 439/752 |
| 2014/0011388 | A1 * | 1/2014 | Muro | 439/352 |
| 2014/0024245 | A1 * | 1/2014 | Uno | 439/374 |
| 2014/0169871 | A1 * | 6/2014 | Nishiyama | 403/374.1 |
| 2014/0194012 | A1 * | 7/2014 | Akagi | 439/701 |

FOREIGN PATENT DOCUMENTS

| | | | |
|---|---|---|---|
| JP | 7-326419 | A | 12/1995 |
| JP | H08-227750 | A | 9/1996 |
| JP | H09-245870 | A | 9/1997 |
| JP | 10-83854 | A | 3/1998 |
| JP | H10-092502 | A | 4/1998 |
| JP | 2001-332335 | A | 11/2001 |
| JP | 2010-040366 | A | 2/2010 |

OTHER PUBLICATIONS

International Search Report dated Sep. 25, 2012 for International application No. PCT/JP2012/066053.

Chinese Office Action issued in Chinese Patent Application No. 201280021211.2 on Apr. 28, 2015.

* cited by examiner

CONNECTOR

TECHNICAL FIELD

The present invention relates to a connector including a connector housing for receiving a terminal fitting, and a spacer inserted into a spacer installation opening of the connector housing to prevent the terminal fitting received in the connector housing from being fallen out.

BACKGROUND ART

In order to prevent a terminal fitting received in a connector housing from being fallen out or being poorly fitted, various connectors have been proposed, which have a connector housing for receiving a terminal fitting and a spacer inserted into a spacer installation opening of the connector housing to prevent the terminal fitting received in the connector housing from being fallen out.

FIGS. 14 to 17 show such a connector according to the related art.

A connector 100 shown in the figures, like a connector disclosed in the below PTL1, has a spacer installation opening 111 provided in a lower surface of a connector housing 110, and a spacer 120 is inserted and installed in the spacer installation opening 111 as indicated by an arrow Z1 in FIG. 14.

FIGS. 15 and 16 shows a state where the spacer 120 inserted in the spacer installation opening 111 is positioned at a temporary locking position by a temporary locking mechanism 130.

The temporary locking position is a position, where the spacer 120 is not engaged with a terminal fitting in the connector housing 110.

The temporary locking mechanism 130 of the shown example, as shown in FIG. 16, is constituted of a pair of positioning protrusions 131 formed to protrude from front ends of both outside walls 121 and 122 of the spacer 120 opposing with each other in a width direction of the connector housing 110, and a pair of locking portions 133 provided on the connector housing 110.

The pair of positioning protrusions 131 are protrusions formed to inwardly protrude from the front ends of both outside walls 121 and 122 of the spacer 120. In addition, the pair of locking portions 133 are engaging grooves, in which the positioning protrusions 131 are engaged when the spacer 120 has been inserted up to the temporary locking position. The pair of locking portions 133 are provided on inner partition walls 113 and 114 in the connector housing 110, which are erected in an opposing state inside of the outside walls 121 and 122.

The spacer 120 can moved from the temporary locking position, as shown in FIGS. 15 and 16, to the main locking position, where the spacer is engaged with the terminal fitting, if a pressing load equal to or greater than a predetermined value is further exerted thereon.

CITATION LIST

Patent Literature

PTL1: JP-A-2010-40366 A

SUMMARY OF INVENTION

Technical Problem

However, in conventional connectors disclosed in PTL1 and the like, a force for locking the spacer at the temporary locking position is not set so high.

Therefore, when transportation or the like of the connector is performed in a state where the spacer is temporarily locked in the connector housing, if external equipment or the like is erroneously contacted with one end of a rear end wall 125 of the spacer 120 during transportation, there is a risk that, due to an impact force F1 at that time, one end of the spacer 120 would have been inadvertently pushed to the main locking position as shown in FIG. 17.

In addition, there is a problem in that, if the spacer would have been advertently pushed to the main locking position, a restoration work of returning the spacer 120 to the original temporary locking position is required when the terminal fitting is received in the connector housing 110, and thus handling properties are poor.

Accordingly, an object of the present invention is to solve the above problems, and to provide a connector, which prevents a spacer inserted into a spacer installation opening of a connector housing from being inadvertently pushed from a temporary locking position to a main locking position due to erroneous contact or the like, and thus has excellent handling properties.

Solution to Problem

The above object of the present invention is achieved by the following configurations.

(1) A connector, including:

a connector housing for receiving a terminal fitting;

a spacer inserted into a spacer installation opening of the connector housing to prevent the terminal fitting received in the connector housing from being fallen out;

a temporary locking mechanism for temporarily fixing the spacer to a temporary locking position where the spacer is not engaged with the terminal fitting; and a main locking mechanism for locking the spacer, which has been pushed toward a more inner side of the housing than the temporary locking position, to a main locking position where the spacer is engaged with the terminal fitting;

wherein the temporary locking mechanism allows the spacer to move from the temporary locking position to the main locking position, only if a pressing load equal to or greater than a first preset value is acted on a location corresponding to the center in a width direction of a rear end surface of the spacer, and also a pressing load equal to or greater than a second preset value is acted on end portions in the width direction of the rear end surface of the spacer.

(2) The connector according to the above (1), wherein the spacer includes a pair of outside walls arranged on both outside portions opposing with each other in the width direction of the connector housing, and is configured to be bending-deformed in a predetermined inclined state where a width of the spacer is narrowed from the front end toward the rear end, if the pressing load equal to or greater than the first preset value is acted on the location corresponding to the center in the width direction of the rear end surface of the spacer, and positioning protrusions provided to protrude from a location on a front end side of the pair of outside walls outward in the width direction of the connector housing;

the connector housing includes locking protrusions protruding from inner surfaces of the connector housing to allow the positioning protrusions to abut thereon when the spacer has been inserted and advanced from the spacer installation opening to the temporary locking position, and serving as the temporary locking mechanism by abutting against the positioning protrusions; and the abutting surfaces between the positioning protrusions and the locking protrusions, which position the spacer at the temporary locking position, are configured so that the positioning protrusions become in a predetermined inclined state, as the pressing load equal to or greater than the first preset value is acted on the location corresponding to the center in the width direction of the rear end surface of the spacer and thus, the pair of outside walls are bending-deformed in the predetermined inclined state, and also so that the inclination angles thereof are set to allow the positioning protrusions to climb over the locking protrusions and move to the main locking position, only if the pressing load equal to or greater than the second preset value is acted in the insertion direction of the spacer on end portions in the width direction of the rear end surface of the spacer.

(3) The connector according to the above (2), wherein the abutting surfaces between the positioning protrusions and the locking protrusions, which position the spacer at the temporary locking position, are inclined so that a position of an inner sides thereof in the width direction of the connector housing is biased forward in an insertion direction of the spacer, and are set to have an acute inclination angle allowing an included angle with respect to a reference plane perpendicular to the insertion direction of the spacer to become less than 45°.

(4) The connector according to any one of the above (1) to (3), wherein a slit is provided on a rear end wall of the spacer connecting between the pair of outside walls to allow the rear end wall to be easily bending-deformed when the pressing load equal to or greater than the first preset value is acted on the location corresponding to the center in the width direction of the rear end surface of the spacer.

(5) The connector according to any one of the above (1) to (4), wherein a tinned portion is provided on the rear end wall of the spacer connecting between the pair of outside walls to allow the rear end wall to be easily bending-deformed when the pressing load equal to or greater than the first preset value is acted on the location corresponding to the center in the width direction of the rear end surface of the spacer.

According to the above configuration (1), the spacer, which has been positioned at the temporary locking position in the connector housing by the temporary locking mechanism, can be moved from the temporary locking position to the main locking position, only if a pressing load equal to or greater than a preset value is acted on each of the center and the end portions of the rear end surface of the spacer.

During transporting or the like, a case in which a pressing load equal to or greater than the preset value is acted on each of the center and the end portions of the rear end surface of the spacer is not occurred. Therefore, there is no case in which the spacer inserted in the spacer installation opening of the connector housing is inadvertently pushed from the temporary locking position to the main locking position due to erroneous contact or the like during transporting or the like.

As a result, when the terminal fitting is received in the connector housing, a restoration work of returning the spacer to the original temporary locking position can be prevented, thereby enhancing handling properties.

According to the above configuration (2), when the location corresponding to the center in the width direction of the rear end surface of the spacer, which has been positioned at the temporary locking position, is pressed, the center of the rear end wall of the spacer providing the rear end surface is bending-deformed in a recessed state, and accompanying with the deformation of the rear end wall, both outside walls of the spacer are bending-deformed in a predetermined inclined state where a width of the spacer is narrowed from the from end toward the rear end. In addition, as both outside walls of the spacer are bending-deformed in the predetermined inclined state, the positioning protrusions provided on both outside walls are abutted against the locking protrusions at an angle steeper than the initial state, and as a result, even if a pressing load acting on the rear end wall of the spacer is small, the positioning protrusions can easily climb over the locking protrusions.

In other words, in a state where the center of the rear end surface of the spacer is not pressed, the positioning protrusions are abutted against the locking protrusions at a gentle angle, and thus, it is necessary to apply a greater pressing load in order to allow the positioning protrusions to climb over the locking protrusions.

Therefore, in a state where the center of the rear end surface of the spacer is not pressed, if an initial inclination angle of the positioning protrusions abutting against the locking protrusions is set so that a pressing load required to allow the positioning protrusions to climb over the locking protrusions 13 is greater than a load acted by erroneous contact during transporting or the like, even when a pressing load due to erroneous contact is acted on any one of the center and the end portions of the rear end surface of the spacer during transporting or the like, a problem in that the spacer is inadvertently moved from the temporary locking position to the main locking position due to erroneous contact can be prevented.

Namely, thanks to the above configuration (2), the technical idea of the above configuration (1) can be realized in which only if a pressing load equal to or greater than a preset load is simultaneously acted on each of the center and the end portions in the width direction of the rear end surface of the spacer, the spacer can be moved from the temporary locking position to the main locking position.

According to the above configuration (3), a force, which is acted between the abutting surfaces of the positioning protrusions and the locking protrusions by a pressing load acted on the rear end surface of the spacer, is such that when an included angle between the abutting surfaces and a reference plane perpendicular to the insertion direction of the spacer is less than 45°, a component in a direction parallel to the abutting surfaces becomes smaller than a component in a direction perpendicular to the abutting surfaces as the included angle becomes smaller, and thus, slip between the abutting surfaces hardly occurs.

Thus, by setting the included angle between the abutting surfaces and the reference plane perpendicular to the insertion direction of the spacer to less than 45' as in the present embodiment, an effect of inhibiting the spacer from being moved from the temporary locking position to the main locking position due to erroneous contact during transporting or the like can be enhanced.

According to the above configuration (4), the rear end wall of the spacer can easily be bending-deformed due to an easily implementable configuration that the rear end wall providing the rear end surface of the spacer is provided with the slit.

Therefore, by pressing the center in the width direction of the spacer, the rear end wall of the spacer can easily be bending-deformed in a desired bended shape in which the central portion hereof is recessed.

According to the above configuration (5), the rear end wall of the spacer can easily be bending-deformed due to an easily implementable configuration that the rear end wall providing the rear end surface of the spacer is provided with the thinned portion.

Therefore, by pressing the center in the width direction of the spacer, the rear end wall of the spacer can easily be bending-deformed in a desired bended shape in which the central portion thereof is recessed.

In the foregoing, the present invention has been briefly described. Also, details of the present invention will be further apparent modes (hereinafter, referred to as) "embodiments") for embodying the invention as described below are thoroughly read with reference to the accompanying drawings.

DESCRIPTION OF EMBODIMENTS

Preferred embodiments of a connector according to the present invention will be now described in detail with reference to the accompanying drawings.

Figure 1:
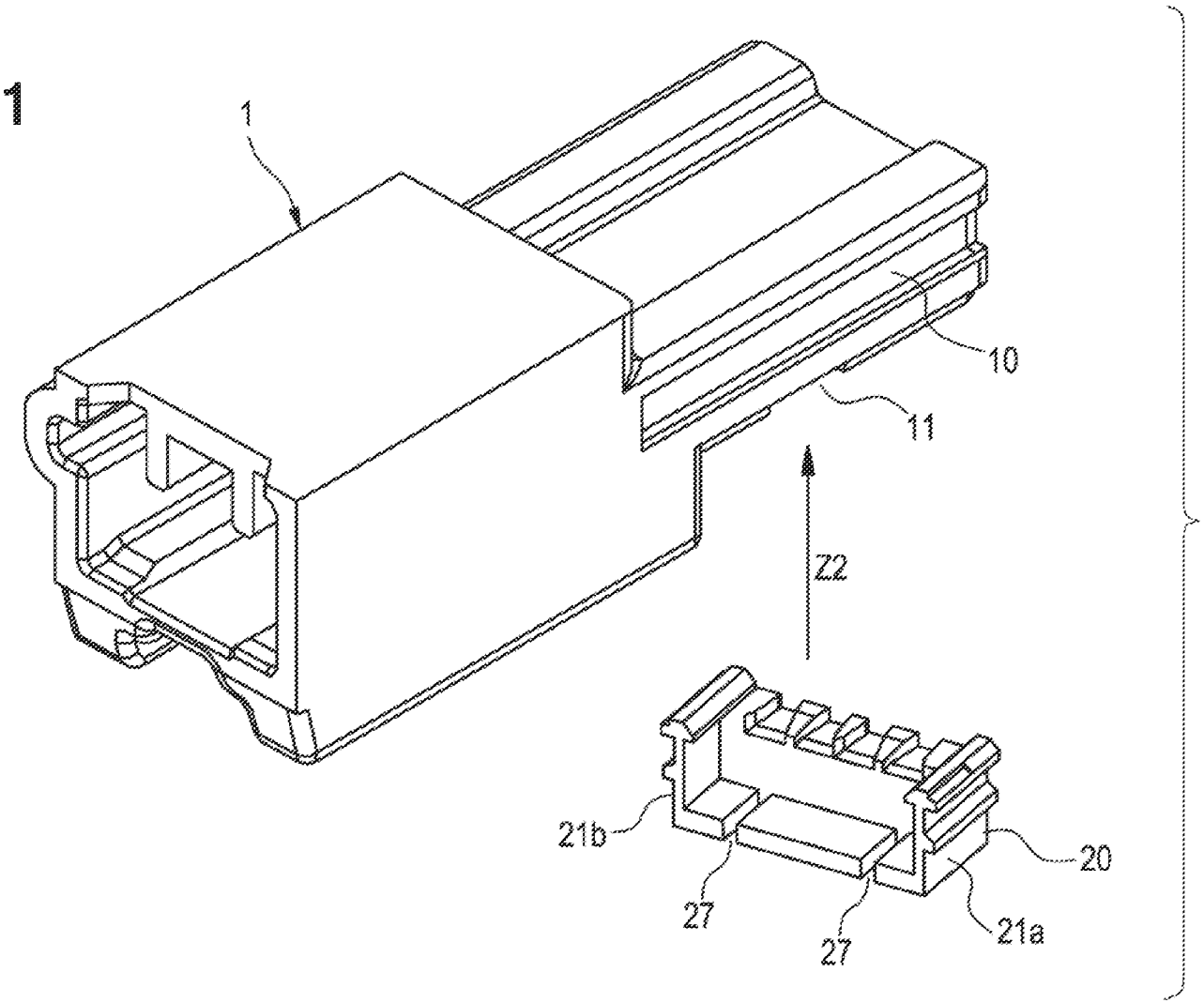
FIG. 1 is an exploded perspective view of one embodiment of a connector according to the present invention.
Figure 2:
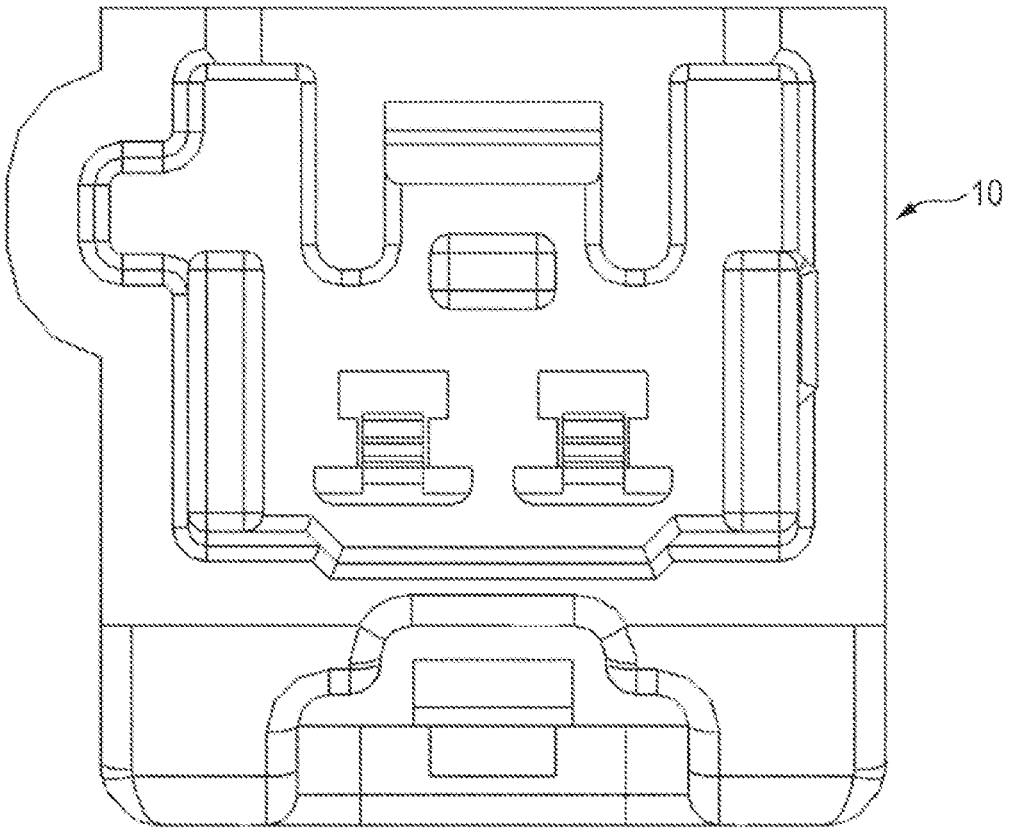
FIG. 2 is a front view of a connector housing shown in FIG. 1.
Figure 3:
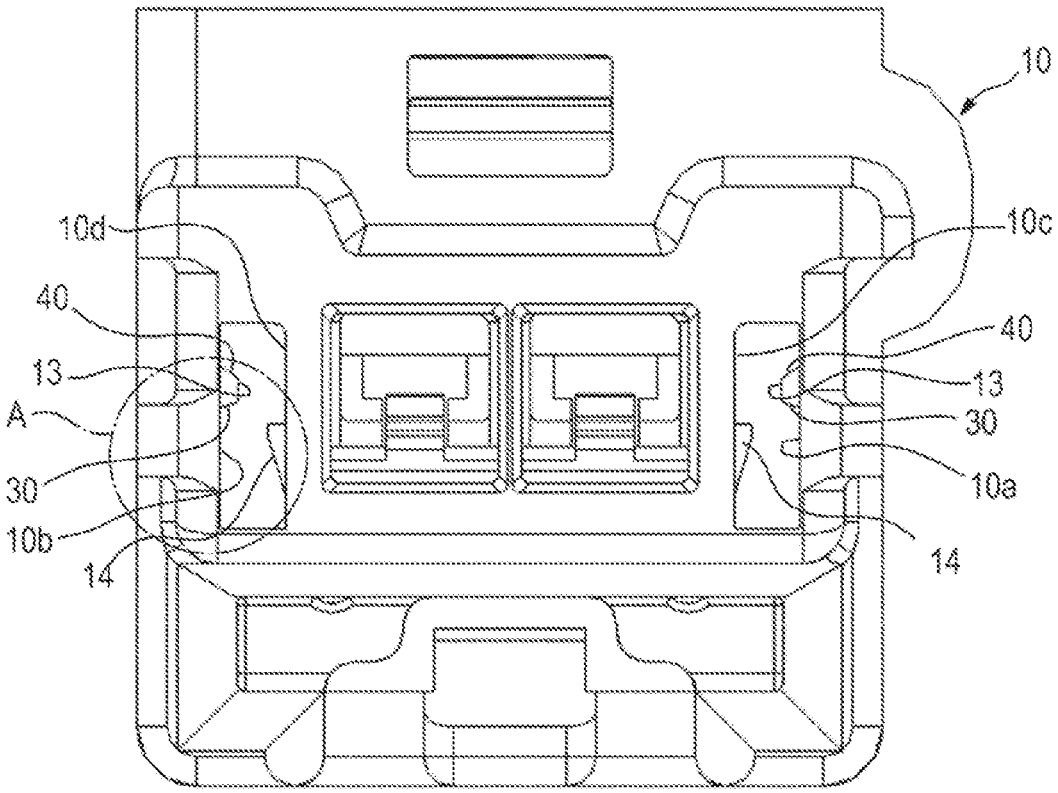
FIG. 3 is a rear view of the connector housing showing a mechanism for locking a spacer in the connector housing shown in FIG. 1.
Figure 4:
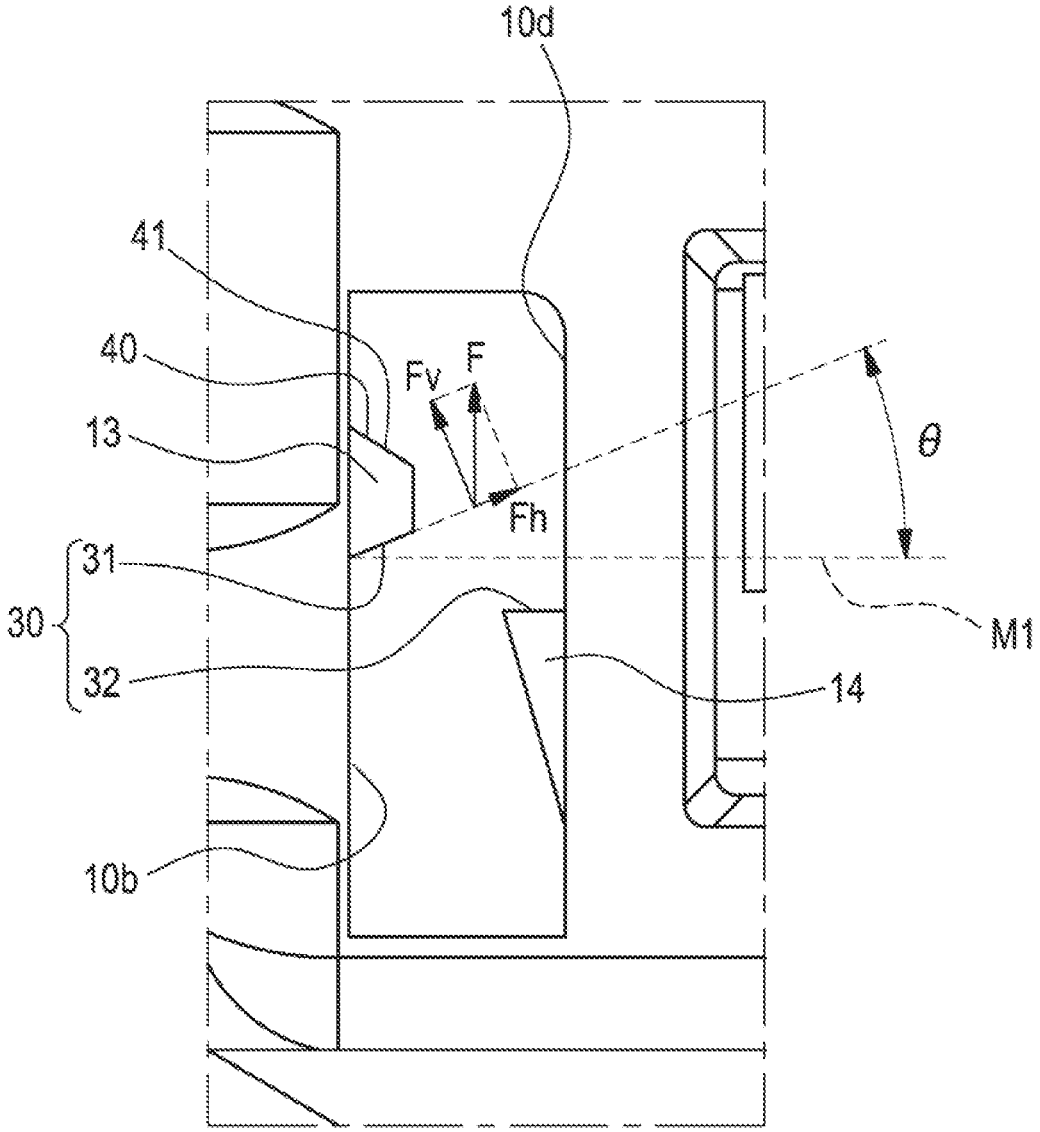
FIG. 4 is an enlarged view of a section A shown in FIG. 3.
Figure 5:
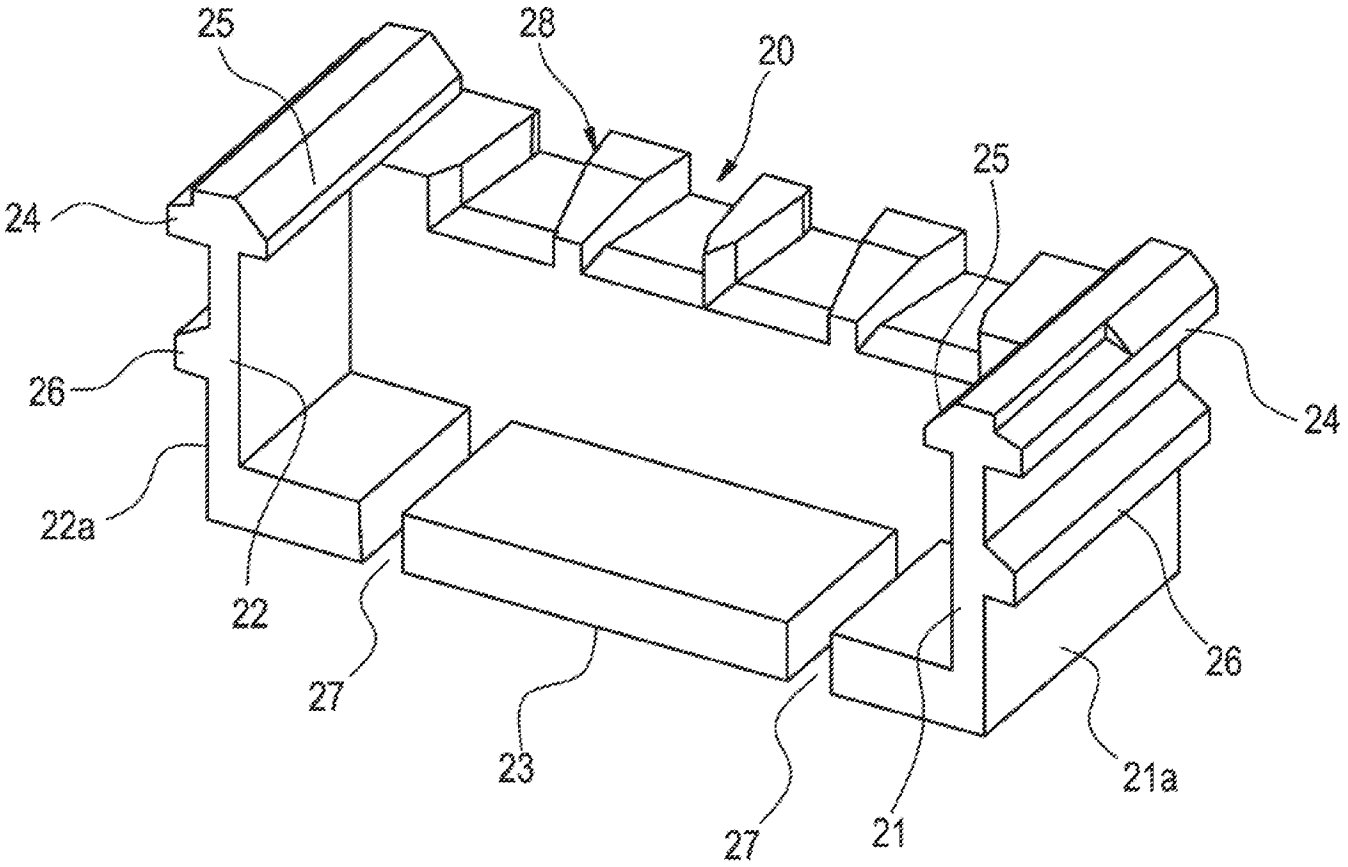
FIG. 5 is an enlarged view of the spacer shown in FIG. 1.
Figure 6:
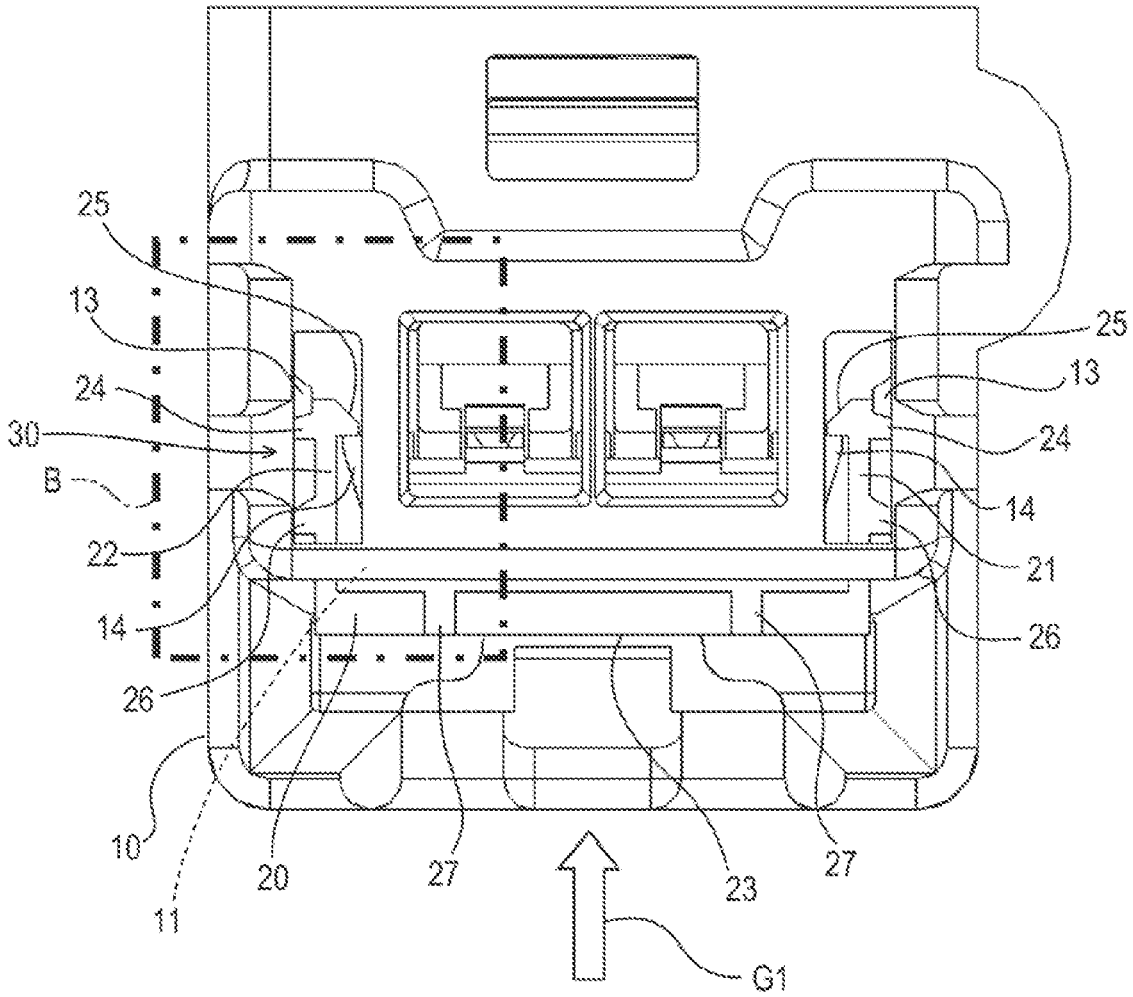
FIG. 6 is a rear view showing a state where the spacer is temporarily fixed to the connector housing shown in FIG. 3.
Figure 7:
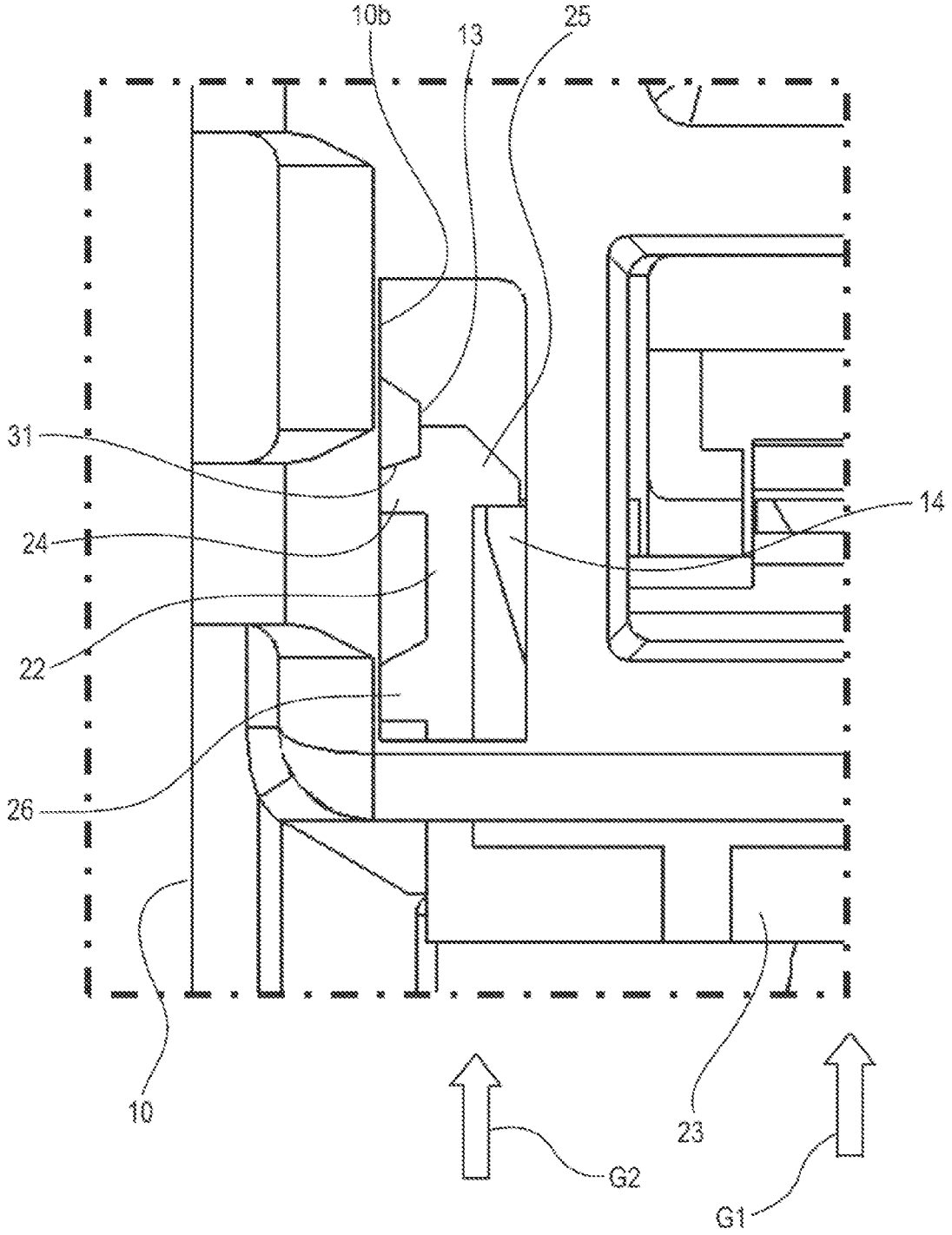
FIG. 7 is an enlarged view of a section B in FIG. 6.
Figure 8:
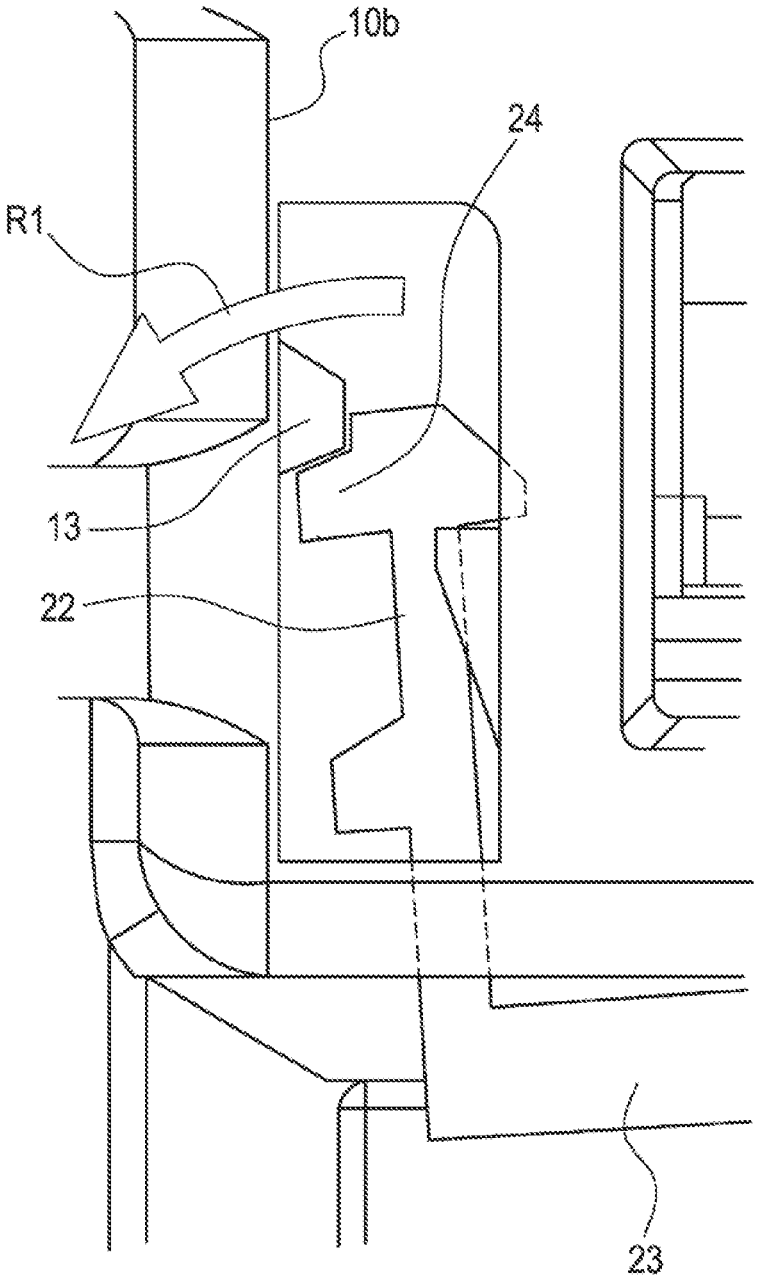
FIG. 8 is an enlarged view showing an engagement state between positioning protrusions and locking protrusions, when both side walls of the spacer are inclined as the central portion in the width direction of the spacer temporarily locked to the connector housing is pressed.
Figure 9:
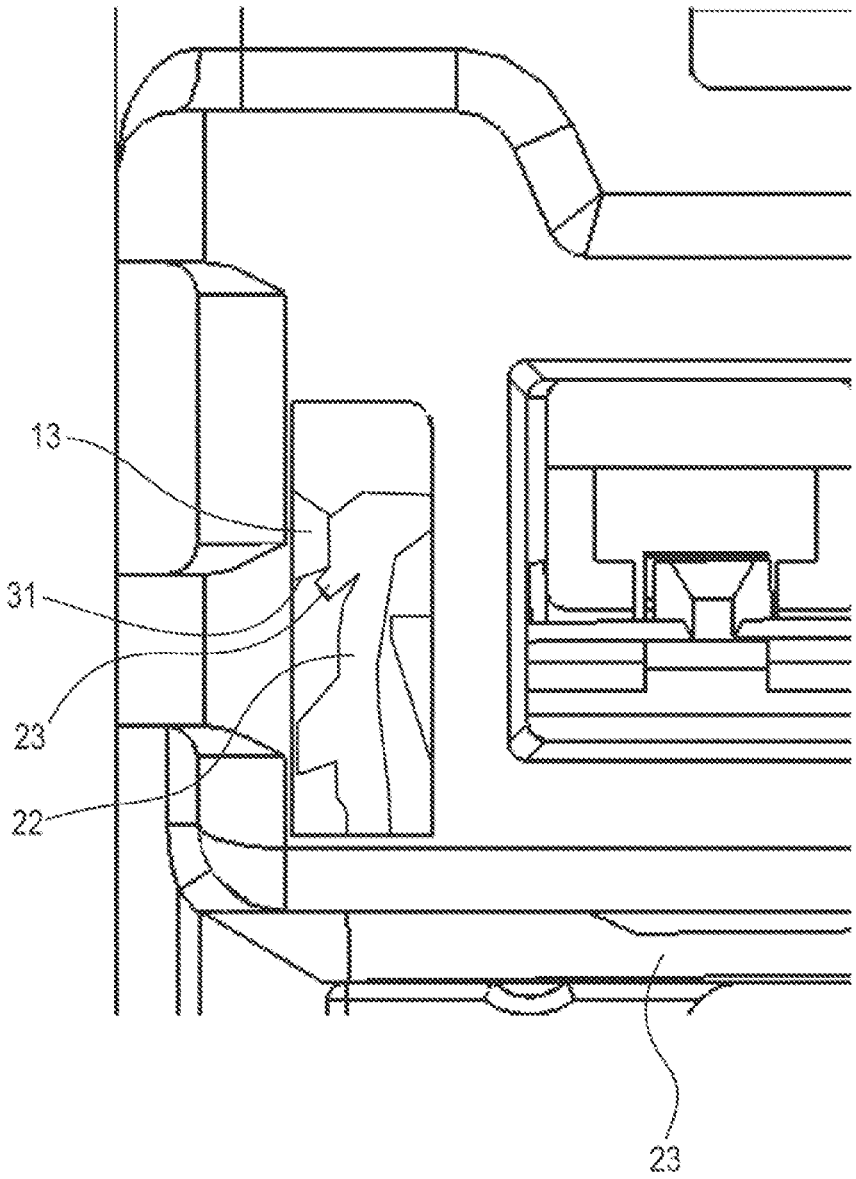
FIG. 9 is a view, as seen from the rear side, showing a state where positioning protrusions starts to climb over the locking protrusions as the central portion and end portions in the width direction of the spacer temporarily locked to the connector housing are respectively pressed.
Figure 10:
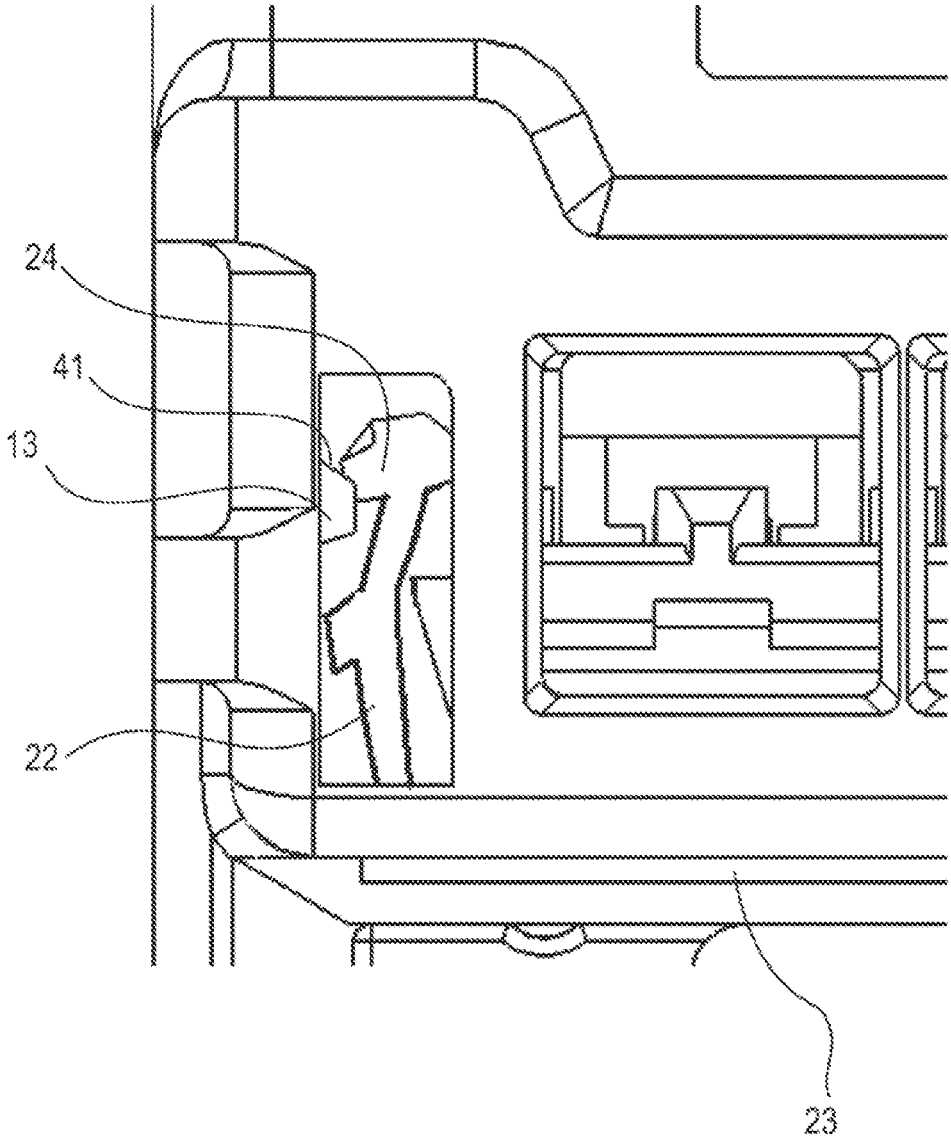
FIG. 10 is a view, as seen from the rear side, showing a state where a climbing operation of the positioning protrusions over the locking protrusions is near completed as the central portion and the end portions in the width direction of the spacer temporarily locked to the connector housing are respectively pressed.
Figure 11:
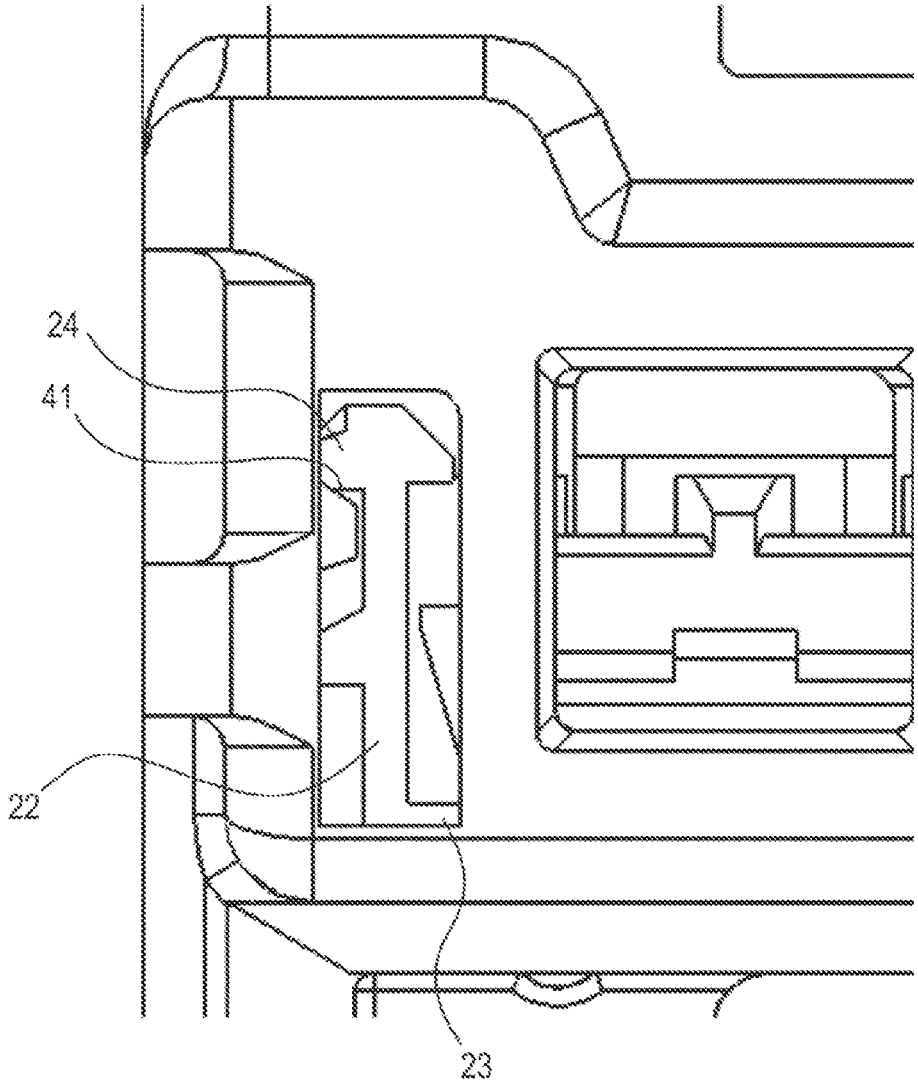
FIG. 11 is a view, as seen from the rear side, showing a, state where the positioning protrusions have been moved to a main locking position over the locking protrusions as the central portion and the end portions in the width direction of the spacer temporarily locked to the connector housing are respectively pressed.

FIGS. 1 to 11 illustrate one embodiment of a connector according to the present invention, in which FIG. 1 is an exploded perspective view of one embodiment of the connector; FIG. 2 is a front view of a connector housing shown in FIG. 1; FIG. 3 is a rear view of the connector housing showing a mechanism for locking a spacer in the connector housing shown in FIG. 1; FIG. 4 is an enlarged view of a section A shown in FIG. 3; FIG. 5 is an enlarged view of the spacer shown in FIG. 1; FIG. 6 is a rear view showing a state where the spacer is temporarily fixed to the connector housing shown in FIG. 3; FIG. 7 is an enlarged view of a section B in FIG. 6; FIG. 8 is an enlarged view showing an engagement state between a positioning protrusions and locking protrusions, when both side walls of the spacer are inclined as the central portion in the width direction of the spacer temporarily locked to the connector housing is pressed; FIG. 9 is a view, as seen from the rear side, showing a state where the positioning protrusions start to climb over the locking protrusions as the central portion and end portions in the width direction of the spacer temporarily locked to the connector housing are respectively pressed; FIG. 10 is a view, as seen from the rear side, showing a state where a climbing operation of the positioning protrusions over the locking protrusions is near completed as the central portion and the end portions in the width direction of the spacer temporarily locked to the connector housing are respectively pressed; and FIG. 11 is a view, as seen from the rear side, showing a state where the positioning protrusions have been moved to a main locking position over the locking protrusions as the central portion and the end portions in the width direction of the spacer temporarily locked to the connector housing are respectively pressed.

As shown in FIGS. 1 to 3, the connector 1 according to the embodiment includes a connector housing 10 for receiving a terminal fitting (not shown); a spacer 20 inserted into a spacer installation opening 11 of the connector housing 10 to prevent the terminal fitting received in the connector housing 10 from being fallen out; a temporary locking mechanism 30 for temporarily fixing the spacer 20 to a temporary locking position where the spacer 20 is not engaged with the terminal fitting; and a main locking mechanism 40 for locking the spacer 20, which has been pushed toward a more inner side of the housing than the temporary locking position, to a main locking position where the spacer 20 is engaged with the terminal fitting.

As shown in FIG. 1, the connector housing 10 has, in a lower surface thereof, the spacer installation opening 11 at a location slightly toward a rear end thereof. The spacer 20 is installed in the connector housing 10 by inserting into the spacer installation opening 11 along a direction of an arrow Z2 shown in FIG. 1.

As shown FIGS. 3 and 4, a first locking protrusion 13 and a second locking protrusion 14 are provided on an inner portion of the spacer installation opening 11 of the connector housing 10.

The first locking protrusion as shown FIGS. 3 and 4, is formed to protrude inward from a pair of inner surfaces 10*a* and 10*b* opposing to both outer surfaces 21*a* and 22*a* (see FIG. 5) the width direction of the spacer 20 inserted in the spacer installation opening 11.

As shown in FIG. 4, the first locking protrusion 13 has a temporary locking tapered surface 31 on a lower side thereof, and a main locking tapered surface 41 on an upper side thereof.

The temporary locking tapered surface 31 is a tapered surface facing the spacer installation opening 11. The temporary locking tapered surface 31 is inclined so that an position of an inner side thereof in the width direction of the connector housing 10 is biased forward in an insertion direction (the direction of the arrow Z2 in FIG. 1) of the spacer 20, and is set to have an acute inclination angle allowing an included angle θ with respect to a reference plane M1 (see FIG. 4) perpendicular to the insertion direction of the spacer 20 to become less than 45°.

The temporary locking tapered surface 31 abuts against a positioning protrusion 24, as described below, when the spacer 20 has been inserted and advanced from the spacer installation opening 11 to the temporary locking position, thereby restricting the positioning protrusion 24 from further advancing in the insertion direction.

The second locking protrusion 14 is formed to protrude from outward side surfaces 10*c* and 10*d* which are provided inside the housing to oppose the inner surfaces 10*a* and 10*b* at a more inner side of the housing than the inner surfaces 10*a* and 10*b*. A top end surface of the second locking protrusion 14 engages with an inward protrusion 25 of the spacer 20 when the spacer 20 has been advanced to the temporary locking position, and thus becomes a return restricting surface 32 for restricting the spacer 20 from being returned toward the spacer installation opening 11.

The temporary locking tapered surface 31 and the return restricting surface 32 serve as the temporary locking mechanism 30 for positioning the spacer 20 at the temporary locking position.

The main locking tapered surface 41 of the first locking protrusion 13 locks a rear end surface of the positioning protrusion 24 of the spacer 20, when the positioning protrusion 24 has climbed over the first locking protrusion 13, and thus servers as the main locking mechanism 40 for fixing the spacer 20 to the main locking position.

As shown in FIGS. 5 to 7, the spacer 20 includes a pair of outside walls 21 and 22 arranged on both outside portions opposing with each other in the width direction of the connector housing 10; a rear end wall 23 connecting between the pair of outside walls 21 and 22; the positioning protrusion 24 provided to protrude from a location on a front end side of each of the pair of outside walls 21 and 22 outward in the width direction of the connector housing 10; the inward protrusion 25 provided to protrude from a location on a front end side of each of the pair of outside walls 21 and 22 inward in the width direction of the connector housing 10; a guide protrusion 26 provided to protrude from a location on a rear end side of each of the pair of outside walls 21 and 22 outward in the width direction of the connector housing 10; and a fitting locking portion for restricting the terminal fitting from being fallen out when the spacer 20 has been positioned at the main locking position.

As shown in FIG. 6, the pair of outside walls 21 and 22 are configured to be bending-deformed in a predetermined inclined state where a width of the spacer 20 is narrowed from the front end toward the rear end, if a pressing load G1 equal to or greater than a first preset value is acted on a location corresponding to the center in a width direction of the rear end surface of the spacer 20. FIG. 8 shows a state where the outside wall 22 of the spacer 20 is bending-deformed in the predetermined inclined state by action of a pressing load G1 in FIG. 6.

As shown in FIG. 8, if the outside wall 22 become in the predetermined inclined state, the positioning protrusion 24 formed to protrude from the front end of the outside wall 22 is pivoted in a direction of an arrow R1 in FIG. 8, and is abutted against the first locking protrusion 13 at an angle steeper than the initial state.

The rear end wall 23 of the spacer 20 is provided with a slit 27 allowing the rear end wall 23 to be easily bending-deformed in a state where the center thereof is recessed, when the pressing load G1 equal to or greater than the first preset value is acted on a location corresponding to the center in the width direction of the rear end surface of the spacer 20.

In the present embodiment, two slit 27 are provided as shown in FIG. 5.

When the spacer 20 inserted into the spacer installation opening 11 has been advanced to the temporary locking position, the positioning protrusion 24, as shown in FIGS. 6 and 7, abuts against the temporary locking tapered surface 31 of the first locking protrusion 13 in the housing, thereby restricting the spacer from being further advanced into the housing. When the positioning protrusion 24 has abutted against the temporary locking tapered surface 31, a rear end surface of the inward protrusion 25, as shown in FIG. 7, is locked on the second locking protrusion 14, thereby also restricting the spacer 20 from being returned toward the space installation opening 11.

Namely, the rear end wall 23 and the inward protrusion 25 are cooperated with the temporary locking tapered surface 31 and the return restricting surface 32, thereby serving as the temporary locking mechanism 30 for positioning the spacer 20 at the temporary locking position.

An abutting surface of the positioning protrusion 24, which abuts against the temporary locking tapered surface 31 of the first locking protrusion 13 when the spacer 20 has been advanced to the temporary locking position, is set to have the same inclination as that of the temporary locking tapered surface 31. Namely, the abutting surface of the positioning protrusion 24, which abuts against the temporary locking tapered surface 31 of the first locking protrusion 13 is inclined so that an position of an inner side thereof in the width direction of the connector housing 10 is biased forward in the insertion direction of the spacer 20, and is set to have an acute inclination angle allowing an included angle with respect to a reference plane perpendicular to the insertion direction of the spacer 20 to become less than 45°.

The guide protrusions 26, as shown in FIGS. 6 and 7, slide on and along the inner surfaces 10*a* and 10*b* inside the connector housing 10 when the spacer 20 has been inserted in the spacer installation opening 11, and restrict the outside walls 21 and 22 from being fallen down outward in the width direction.

The temporary locking mechanism 30 of the connector 1 as described above is configured so that the angles of the temporary locking surface 31 and the abutting surface of the positioning protrusion 24 are set to allow the spacer 20 to move from the temporary locking position to the main locking position, only if the pressing load G1 equal to or greater than the first preset value is acted on a location corresponding to the center in the width direction of the rear end surface of the spacer 20, and also a pressing load G2 equal to or greater than a second preset value is acted on end portions in the width direction of the rear end surface of the spacer 20.

More specifically, in the connector 1 according to the present embodiment, the abutting surfaces between the positioning protrusion 24 and the first locking protrusion 13, which position the spacer 20 at the temporary locking position, are configured so that the positioning protrusion 24 becomes in a predetermined inclined state, as the pressing load G1 equal to or greater than the first preset value is acted on a location corresponding to the center in the width direction of the rear end surface of the spacer 20 and thus, as shown in FIG. 8, the pair of outside walls 21 and 22 are bending-deformed in the predetermined inclined state. Additionally, in this state, the inclination angles of the abutting surfaces between the positioning protrusion 24 and the first locking protrusion 13 are set to allow the positioning protrusion 24 to climb over the first locking protrusion 13 and move to the main locking position as shown in FIGS. 9 to 11, only if the pressing load G2 equal to or greater than the second preset value is acted in the insertion direction of the spacer 20 on end portions in the width direction of the rear end surface of the spacer 20 as shown in FIG. 7.

According to the connector 1 of the one embodiment as described above, the spacer 20, which has been positioned at the temporary locking position in the connector housing 10 by the temporary locking mechanism 30, can be moved from the temporary locking position to the main locking position, only if a pressing load equal to or greater than a preset value is acted on each of the center and the end portions of the rear end surface of the spacer 20.

During transporting or the like, a case in which a pressing load equal to or greater than the preset value is acted on each of the center and the end portions of the rear end surface of the spacer 20 is not occurred. Therefore, there is no case in which the spacer 20 held at the temporary locking position by the temporary locking mechanism 30 is inadvertently pushed from the temporary locking position to the main locking position due to erroneous contact or the like during transporting or the like.

As a result, when the terminal fitting is received in the connector housing 10, a restoration work of returning the spacer 20 to the original temporary locking position can be prevented, thereby enhancing handling properties.

Also, according to the connector 1 of the one embodiment, when the location corresponding to the center in the width direction of the rear end surface of the spacer 20, which has been positioned at the temporary locking position, is pressed, the center of the rear end wall 23 of the spacer 20 providing the rear end surface is bending-deformed in a recessed state as shown in FIG. 8, and accompanying with the deformation of the rear end wall 23, both outside walls 21 and 22 of the spacer 20 are bending-deformed in a predetermined inclined state where a width of the spacer 20 is narrowed from the front end toward the rear end.

In addition, as both outside walls 21 and 22 of the spacer 20 are bending-deformed in the predetermined inclined state, the positioning protrusion 24 provided on each of both outside walls 21 and 22 is abutted against the first locking protrusion 13 at an angle steeper than the initial state, and as a result, even if a pressing load acting on the rear end wall 23 of the spacer 20 is small, the positioning protrusion 24 can easily climb over the first locking protrusion 13.

In other words, in a state where the center of the rear end surface of the spacer 20 is not pressed, the positioning protrusion 24 is abutted against the first locking protrusion 13 at a gentle angle, and thus, it is necessary to apply a greater pressing load in order to allow the positioning protrusion 24 to climb over the first locking protrusion 13.

Therefore, in a state where the center of the rear end surface of the spacer 20 is not pressed, if an initial inclination angle of the positioning protrusion 24 abutting against the first locking protrusion 13 is set so that a pressing load required to allow the positioning protrusion 24 to climb over the first locking protrusion 13 is greater than a load acted by erroneous contact during transporting or the like, even when a pressing load due to erroneous contact is acted on any one of the center and the end portions of the rear end surface of the spacer 20 during transporting or the like, a problem in which the spacer 20 is inadvertently moved from the temporary locking position to the main locking position due to erroneous contact can be prevented.

Namely, thanks to the connector 1 of the one embodiment, the technical idea of the prose invention can be realized in which only if a pressing load equal to or greater than a preset load is simultaneously acted on each of the center and the end portions in the width direction of the rear end surface of the spacer 20, the spacer 20 can be moved from the temporary locking position to the main locking position.

Further, according to the connector 1 of the one embodiment, a force, which is acted between the abutting surfaces of the positioning protrusion 24 and the first locking protrusion 13 by a pressing load (F in FIG. 4) acted on the rear end surface of the spacer 20, is such that when an included angle between the abutting surfaces and a reference plane perpendicular to the insertion direction of the spacer 20 is less than 45°, a component (Fh in FIG. 4) in a direction parallel to the abutting surfaces becomes smaller than a component (Fv in FIG. 4) in a direction perpendicular to the abutting surfaces as the included angle becomes smaller, and thus, slip between the abutting surfaces hardly occurs.

Thus, by setting the included angle between the abutting surfaces and the reference plane perpendicular to the insertion direction of the spacer 20 to less than 45° as in the present embodiment, an effect of inhibiting the spacer 20 from being moved from the temporary locking position to the main locking position due to erroneous contact during transporting or the like can be enhanced.

In addition, according to the connector 1 of the one embodiment, the rear end wall 23 of the spacer 20 can easily be bending-deformed due to an easily implementable configuration that the rear end wall 23 providing the rear end surface of the spacer 20 is provided with the slit 27.

Therefore, by pressing the center in the width direction of the spacer 20, the rear end wall 23 of the spacer 20 can easily be bending-deformed in a desired bended shape in which the central portion thereof is recessed.

Meanwhile, the connector according to the present invention is not limited to the foregoing embodiment, but appropriate changes, modifications or the like thereof can be made.

For example, a means for allowing the rear end wall to be easily bending-deformed when a pressing load equal to or greater than the first preset value is acted on the location corresponding to the center in the width direction of the rear end surface of the spacer is not limited to the foregoing embodiment.

Figure 12:
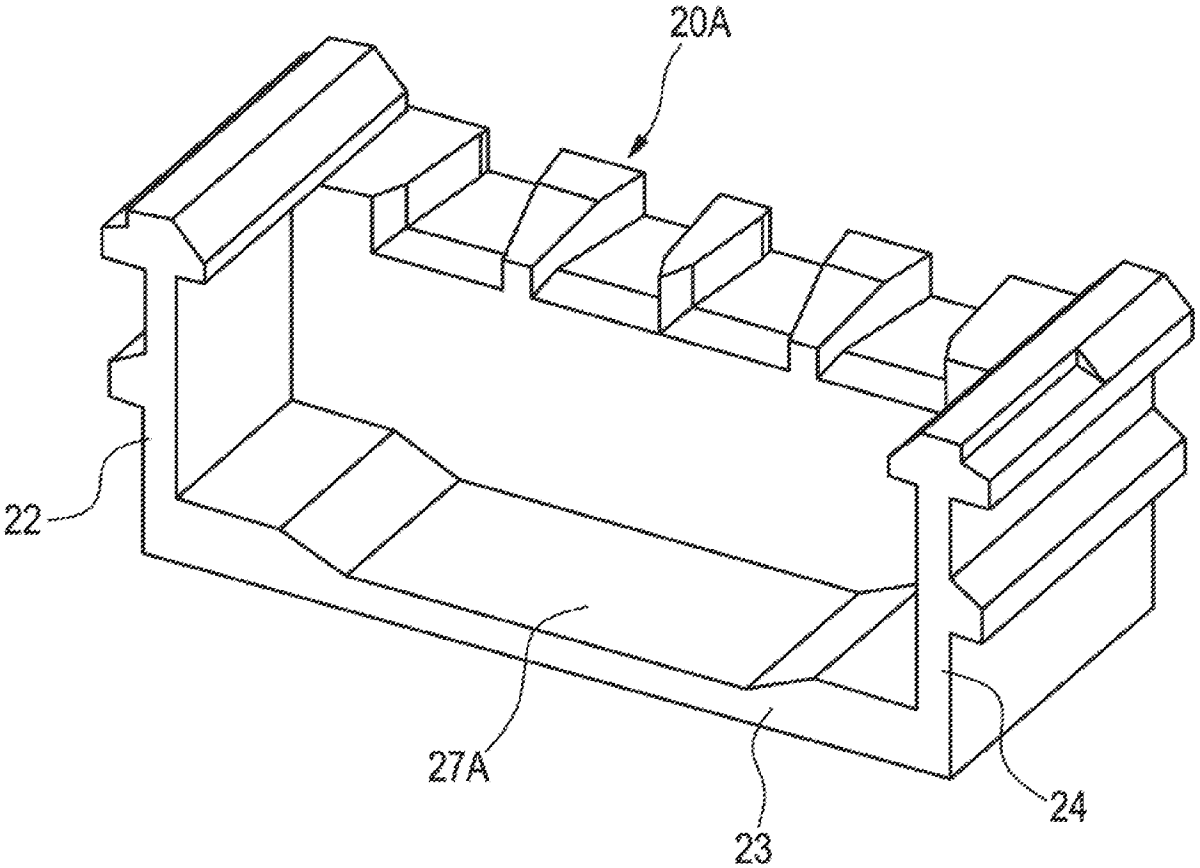
FIG. 12 is a perspective view of another embodiment of the spacer used in the connector of the present invention.

For example, in a spacer 20A shown in FIG. 12, instead of the slit 27 as described in the one embodiment, a thinned portion 27A is provided as a means for allowing the rear end wall 23 to be easily bending-deformed.

According to the configuration shown in FIG. 2, the rear end wall 23 of the spacer 20 can easily be bending-deformed due to an easily implementable configuration that the rear end wall 23 providing the rear end surface of the spacer 20 is provided with the thinned portion 27A.

Therefore, by pressing the center in the width direction of the spacer 20A, the rear end wall 23 of the spacer 20A can easily be bending-deformed in a desired bended shape in which the central portion thereof is recessed.

In addition, when the rear end wall is provided with the slit as a means for allowing the rear end wall of the spacer to be easily bending-deformed, the number or the specific shape of the slit provided is not limited to the foregoing embodiment.

Figure 13:
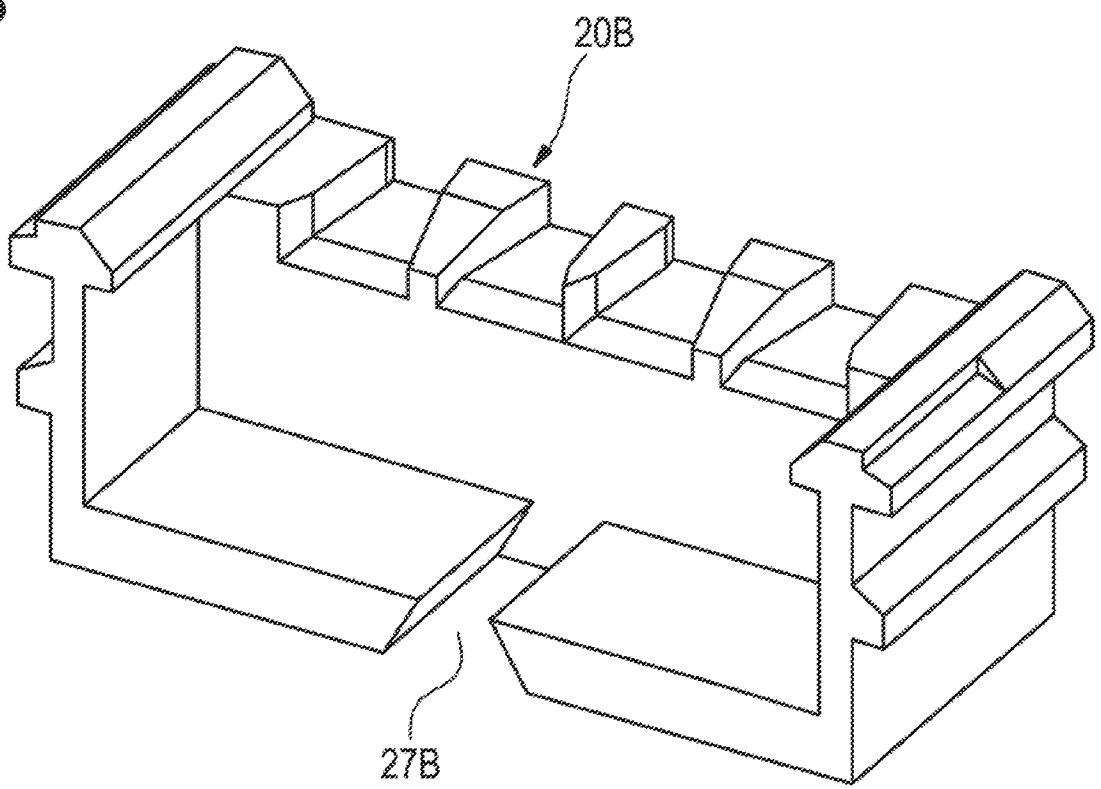
FIG. 13 is a perspective view of a further embodiment of the spacer used in the connector of the present invention.
Figure 14:
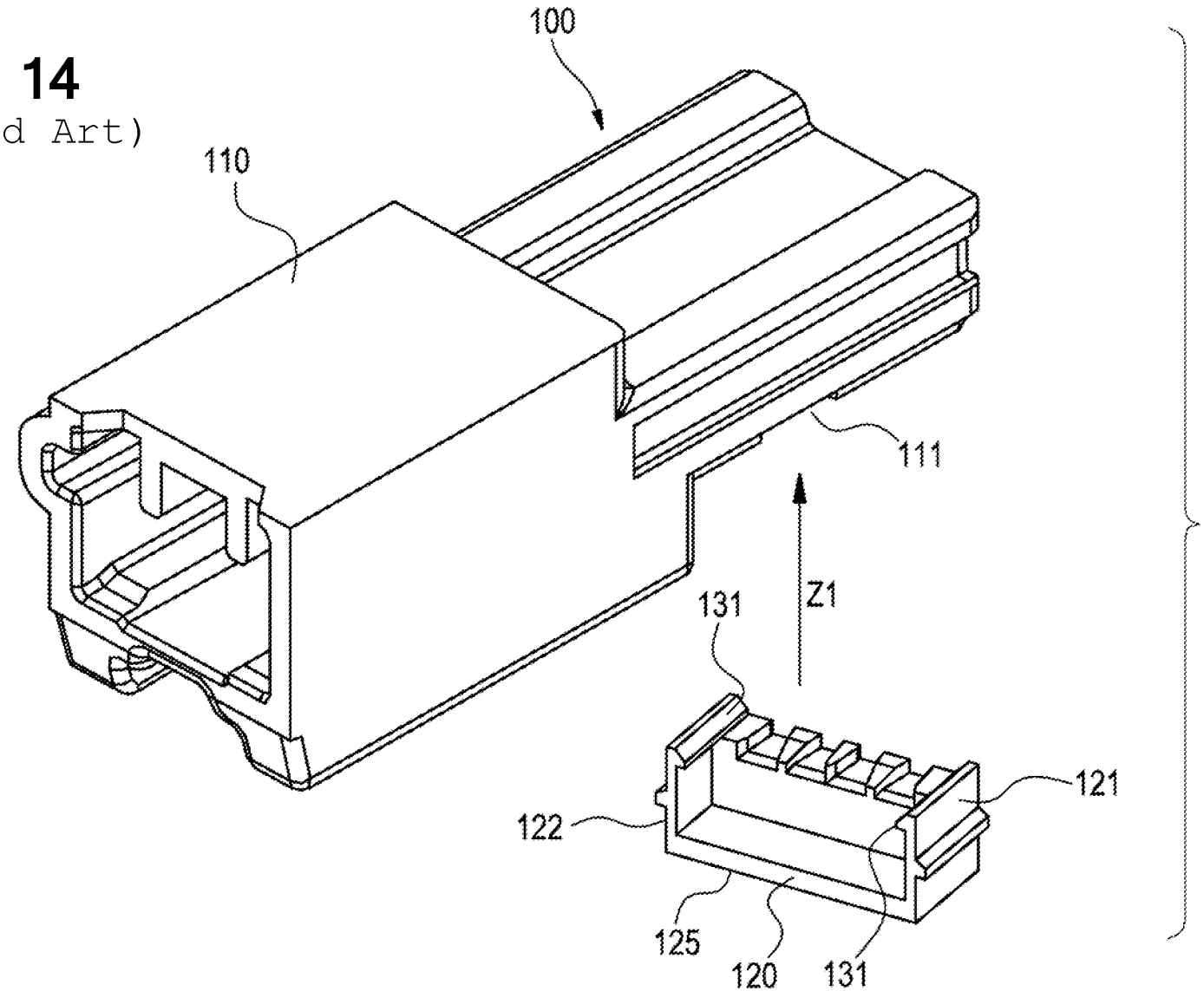
FIG. 14 (Related Art)
FIG. 14 is an exploded perspective view of a connector according to the related art.
Figure 15:
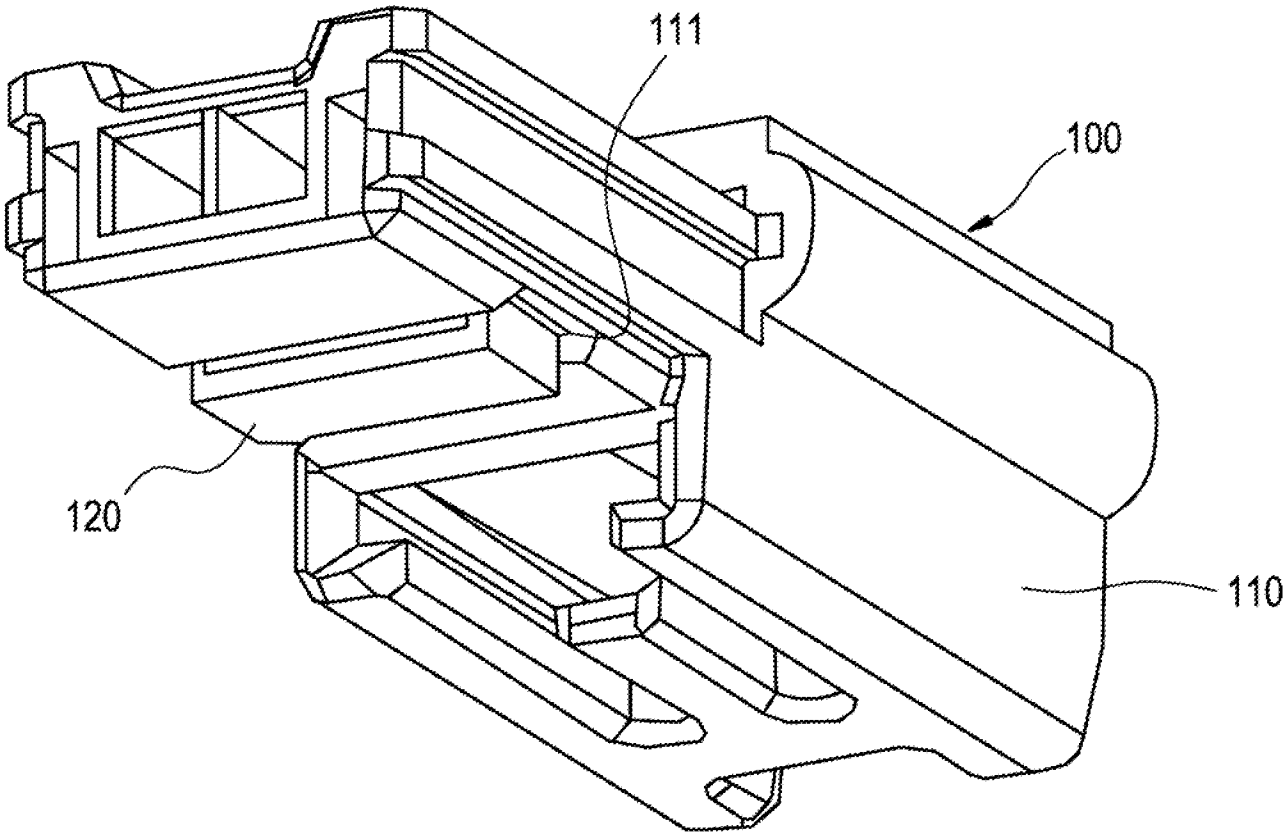
FIG. 15 (Related Art)
FIG. 15 is a perspective view of a state where a spacer is positioned at a temporary locking position in the connector according to the related art.
Figure 16:
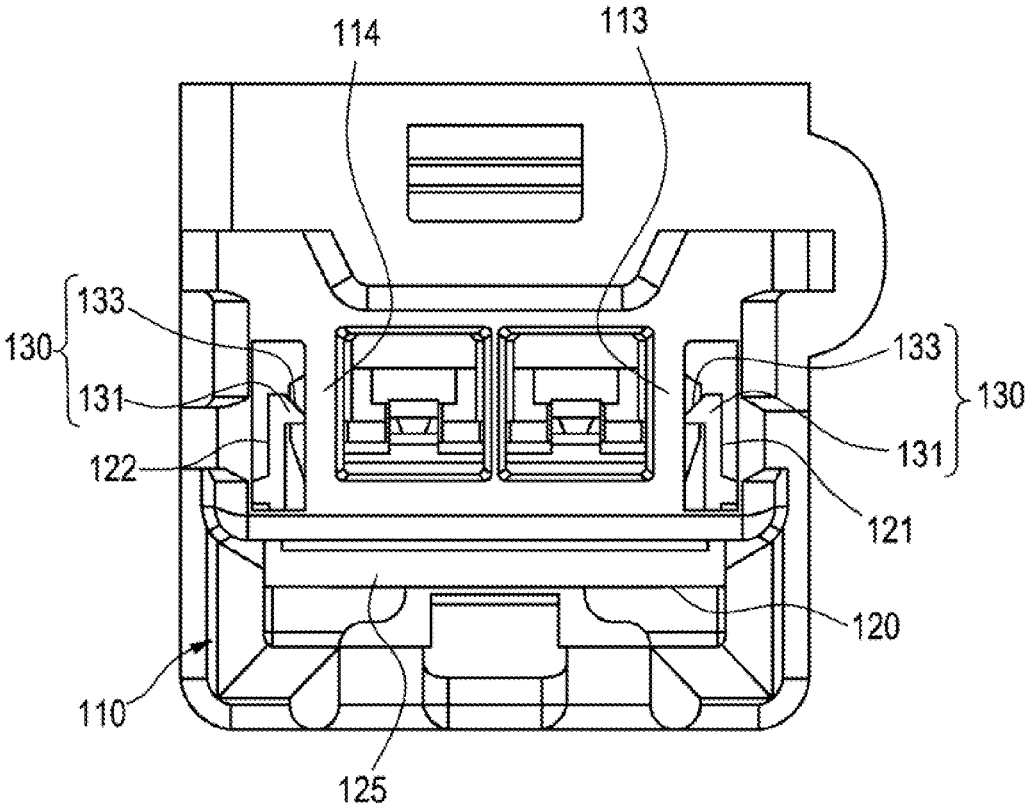
FIG. 16 (Related Art)
FIG. 16 is a rear view showing an attachment state of the spacer the connector shown in FIG. 15.
Figure 17:
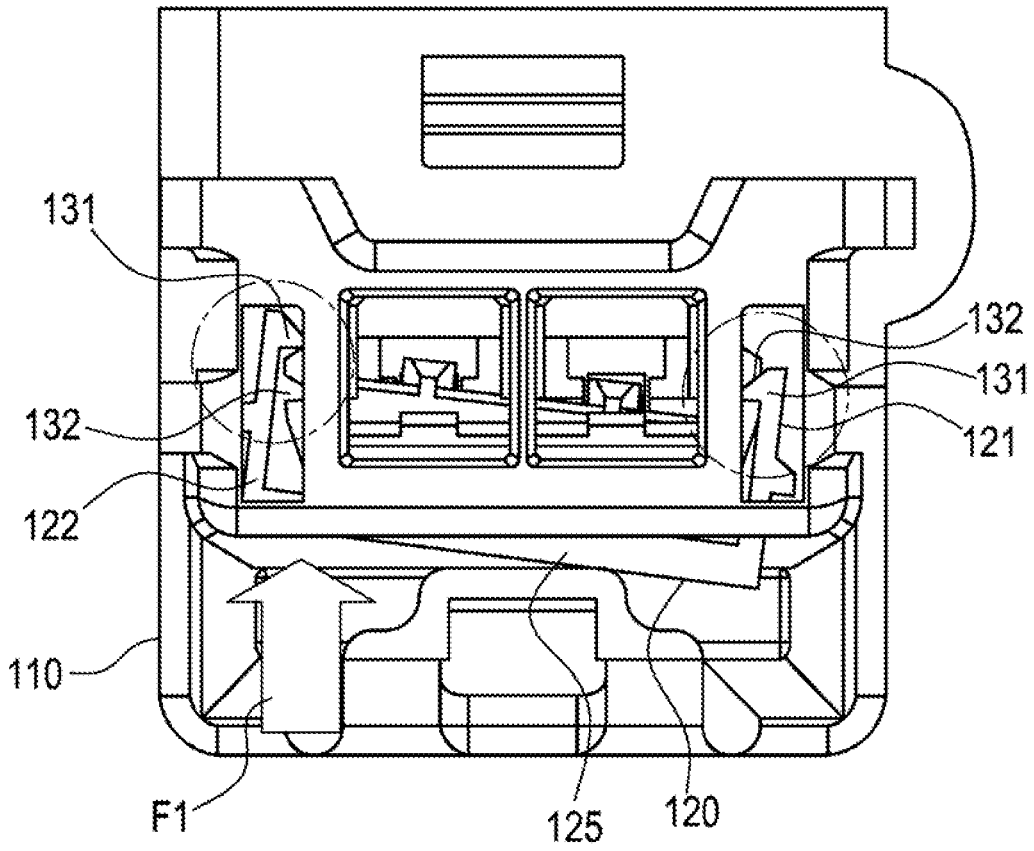
FIG. 17 (Related Art)
FIG. 17 is a rear view showing a state where one end side of the spacer of the connector shown in FIG. 15 is moved from the temporary locking position to a main locking position.

For example, in a spacer 20B shown in FIG. 13, instead of two slit 27 as described in the one embodiment, one slit 27B having a cross-sectional shape different from that of the one embodiment is provided as a means for allowing the rear end wall 23 to be easily bending-deformed.

As described above, by modifying the cross-sectional shape or the number of the slit provided in the rear end wall, bending characteristics of the rear end wall of the spacer may be adjusted.

The present invention is not limited to the foregoing embodiments, but appropriate changes, modifications or the like thereof can be made. In addition, material, shape, dimension, number, installation position and the like of each of the components of the foregoing embodiment are not limited but arbitrary as long as the present invention can be achieved.

Although the present invention has been described with referenced to the detailed and specific embodiment, it should be apparent to those skilled in the art that numerous changes and modifications can be made without departing the scope and spirit of the present invention.

This application claims the benefit of Japanese Patent Application Serial No, 2011-140766 filed on June 2011, the entire contents of which are incorporated herein by reference.

Here, features of embodiments of the connector according to the present invention will be respectively briefly summarized and listed in the following [1] to [5].

[1] A connector (1), including:

a connector housing (10) for receiving a terminal fitting;

a spacer (20, 20A, 20B) inserted into a spacer installation opening (11) of the connector housing (10) to prevent the terminal fitting received in the connector housing (10) from being fallen out;

a temporary locking mechanism (30) for temporarily fixing the spacer (20, 20A, 20B) to a temporary locking position where the spacer (20, 20A, 20B) is not engaged with the terminal fitting; and a main locking mechanism (40) for locking the spacer (20, 20A, 20B), which has been pushed toward a more inner side of the housing than the temporary locking position, to a main locking position where the spacer (20, 20A, 20B) is engaged with the terminal fitting;

wherein the temporary locking mechanism (30) allows the spacer (20, 20A, 20B) to move from the temporary locking position to the main locking position, only if a pressing load (G1) equal to or greater than a first preset value is acted on a location corresponding to the center in a width direction of a rear end surface of the spacer (20, 20A, 20B), and also a pressing load (G2) equal to or greater than a second preset value is acted on end portions in the width direction of the rear end surface of the spacer (20, 20A, 20B).

[2] The connector (1) according to the above [1], wherein the spacer (20, 20A, 20B) includes a pair of outside walls (21, 22) arranged on both outside portions opposing with each other in the width direction of the connector housing (10), and is configured to be bending-deformed in a predetermined inclined state where a width of the spacer (20, 20A, 20B) is narrowed from the front end toward the rear end, if the pressing load (G1) equal to or greater than the first preset value is acted on the location corresponding to the center in the width direction of the rear end surface of the spacer (20, 20A, 20B), and positioning protrusions (24) provided to protrude from a location on a front end side of the pair of outside walls (21, 22) outward in the width direction of the connector housing (10);

the connector housing (10) includes locking protrusions (13) protruding from inner surfaces of the connector housing (10) to allow the positioning protrusions (24) to abut thereon when the spacer (20, 20A, 20B) has been inserted and advanced from the spacer installation opening (11) to the temporary locking position, and serving as the temporary locking mechanism (30) by abutting against the positioning protrusions (24); and the abutting surfaces between the positioning protrusions (24) and the locking protrusions (13), which position the spacer (20, 20A, 20B) at the temporary locking position, are configured so that the positioning protrusions (24) become in a predetermined inclined state, as the pressing load (G1) equal to or greater than the first preset value is acted on the location corresponding to the center in the width direction of the rear end surface of the spacer (20, 20A, 20B) and thus, the pair of outside walls (21, 22) are bending-deformed in the predetermined inclined state, and also so that the inclination angles (θ) thereof are set to allow the positioning protrusions (24) to climb over the locking protrusions (13) and move to the main locking position, only if the pressing load (G2) equal to or greater than the second preset value is acted in the insertion direction of the spacer (20, 20A, 20B) on end portions in the width direction of the rear end surface of the spacer (20, 20A, 20B).

[3] The connector (1) according to the above [2], wherein the abutting surfaces between the positioning protrusions (24) and the locking protrusions (13), which position the spacer (20, 20A, 20B) at the temporary locking position, are inclined so that a position of an inner sides thereof in the width direction of the connector housing (10) is biased forward in an insertion direction of the spacer (20, 20A, 20B), and are set to have an acute inclination angle allowing an included angle (θ) with respect to a reference plane (M1) perpendicular to the insertion direction of the spacer (20, 20A, 20B) to become less than 45'.

[4] The connector 1) according to any one of the above [1] to [3], wherein a slit (27B) is provided on a rear end wall (23) of the spacer (20, 20A, 20B) connecting between the pair of outside walls (21, 22) to allow the rear end wall (23) to be easily bending-deformed when the pressing load (G1) equal to or greater than the first preset value is acted on the location corresponding to the center in the width direction of the rear end surface of the spacer (20, 20A, 20B).

[5] The connector (1) according to any one of the above [1] to [4], wherein a tinned portion (27A) is provided on the rear end wall (23) of the spacer (20, 20A, 20B) connecting between the pair of outside walls (21, 22) to allow the rear end wall (23) to be easily bending-deformed when the pressing load (G1) equal to or greater than the first preset value is acted on the location corresponding to the center in the width direction of the rear end surface of the spacer (20, 20A, 20B).

INDUSTRIAL APPLICABILITY

According to the connector of the present in on, the spacer, which has been positioned at the temporary locking position in the connector housing by the temporary locking mechanism, can be moved from the temporary locking position to the main locking position, only if a pressing load equal to or greater than a preset value is acted on each of the center and the end portions of the rear end surface of the spacer.

During transporting or the like, a case in which a pressing load equal to or greater than the preset value is acted on each of the center and the end portions of the rear end surface of the spacer is not occurred. Therefore, there is no case in which the spacer inserted in the spacer installation opening of the connector housing is inadvertently pushed from the temporary locking position to the main locking position due to erroneous contact or the like during transporting or the like.

As a result, when the terminal fitting is received in the connector housing, a restoration work of returning the spacer to the original temporary locking position can be prevented, thereby enhancing handling properties.

REFERENCE NUMERALS LIST

1 Connector
10 Connector housing
11 Spacer installation opening

13 First locking protrusion (Locking protrusion)
14 First locking protrusion (Locking protrusion)
20, 20A, 20B Spacer
21, 22 Outside wall
24 Positioning protrusion
25 Inward protrusion
27, 27A Slit
30 Temporary locking mechanism
31 Temporary locking tapered surface
40 Main locking mechanism
41 Main locking tapered surface
G1 Pressing load

The invention claimed is:

1. A connector, comprising:

a connector housing that receives a terminal fitting;

a spacer that is inserted into a spacer installation opening of the connector housing to prevent the terminal fitting received in the connector housing from being fallen out;

a temporary locking mechanism that temporarily fixes the spacer to a temporary locking position where the spacer is not engaged with the terminal fitting; and a main locking mechanism that locks the spacer pushed toward a more inner side of the housing than the temporary locking position to a main locking position where the spacer is engaged with the terminal fitting, wherein the temporary locking mechanism allows the spacer to move from the temporary locking position to the main locking position, when a pressing load equal to or greater than a first preset value is acted on a location corresponding to the center in a width direction of a rear end surface of the spacer and a pressing load equal to or greater than a second preset value is acted on end portions in the width direction of the rear end surface of the spacer, and wherein the spacer includes a pair of outside walls arranged on both outside portions opposing with each other in the width direction of the connector housing, and is configured to be bending-deformed in a predetermined inclined state where a width of the spacer is narrowed from the front end toward the rear end, if the pressing load equal to or greater than the first preset value is acted on the location corresponding to the center in the width direction of the rear end surface of the spacer, and positioning protrusions provided to protrude from a location on a front end side of the pair of outside walls outward in the width direction of the connector housing;

the connector housing includes locking protrusions protruding from inner surfaces of the connector housing to allow the positioning protrusions to abut thereon when the spacer has been inserted and advanced from the spacer installation opening to the temporary locking position, and serving as the temporary locking mechanism by abutting against the positioning protrusions; and the abutting surfaces between the positioning protrusions and the locking protrusions, which position the spacer at the temporary locking position, are configured so that the positioning protrusions become in a predetermined inclined state, as the pressing load equal to or greater than the first preset value is acted on the location corresponding to the center in the width direction of the rear end surface of the spacer and thus, the pair of outside walls are bending-deformed in the predetermined inclined state, and also so that the inclination angles of are set to allow the positioning protrusions to climb over the locking protrusions and move to the main locking position, only if the pressing load equal to or greater than the second preset value is acted in the insertion direction of the spacer on end portions in the width direction of the rear end surface of the spacer.

2. The connector according to claim 1, wherein the abutting surfaces between the positioning protrusions and the locking protrusions, which position the spacer at the temporary locking position, are set so that a position of an inner sides thereof in the width direction of the connector housing is headed to an insertion direction of the spacer, and are set to have an acute inclination angle allowing an included angle with respect to a reference plane perpendicular to the insertion direction of the spacer to become less than 45°.

* * * * *